US010582766B2

(12) United States Patent
Leng

(10) Patent No.: US 10,582,766 B2
(45) Date of Patent: Mar. 10, 2020

(54) FOLDING TABLE

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 16/082,832

(22) PCT Filed: Mar. 7, 2017

(86) PCT No.: PCT/CN2017/075813
§ 371 (c)(1),
(2) Date: Sep. 6, 2018

(87) PCT Pub. No.: WO2017/152825
PCT Pub. Date: Sep. 14, 2017

(65) Prior Publication Data

US 2019/0090626 A1 Mar. 28, 2019

(30) Foreign Application Priority Data

Mar. 7, 2016 (CN) ..... 2016 2 0171182 U
Mar. 7, 2016 (CN) ..... 2016 2 0171679 U

(51) Int. Cl.
*A47B 3/08* (2006.01)
*A47B 3/087* (2006.01)
*A47B 3/091* (2006.01)

(52) U.S. Cl.
CPC ..... *A47B 3/0809* (2013.01); *A47B 3/087* (2013.01); *A47B 3/0918* (2013.01)

(58) Field of Classification Search
CPC ..... A47B 3/0809; A47B 3/087; A47B 3/0918; A47B 3/0815; A47B 3/083
USPC ..... 108/169, 168, 131, 132, 133
See application file for complete search history.

(56) References Cited

U.S. PATENT DOCUMENTS 161,123 A * 3/1875 Howland ..... A47B 3/087 108/168
1,453,504 A * 5/1923 Janisch ..... A47B 3/087 5/111
1,491,568 A * 4/1924 Tepper ..... A47B 3/087 190/12 R (Continued)

FOREIGN PATENT DOCUMENTS

CN 2509921 Y 9/2002
CN 2647128 Y 10/2004

(Continued)

*Primary Examiner* — Jose V Chen
(74) *Attorney, Agent, or Firm* — Cooper Legal Group, LLC

(57) ABSTRACT

Disclosed is a folding table, which comprises table legs and support bars, the table legs are pivoted at the bottom portion of a table top, one end of the support bar is pivoted to the table leg, the other end of the support bar is disposed with a sliding hook, the sliding hook is slidable along the side edge of the table top in the table leg, the side edge of the table top is disposed with a lock groove with an opening; when the table leg is unfolded, the sliding hook is embedded in the lock groove; when the table leg is being folded, the external force is acted on the support bar to make the sliding hook separating from the lock groove and then the table leg is folded.

15 Claims, 13 Drawing Sheets

(56) References Cited

U.S. PATENT DOCUMENTS 1,576,455 A * 3/1926 Parker ..... A47B 3/0918 108/131
2,470,869 A * 5/1949 Schmidt ..... A47B 3/0918 108/132
2,643,926 A * 6/1953 Pucci ..... A47B 3/083 108/131
2,672,387 A * 3/1954 Barricks ..... A47B 3/0918 108/133
2,712,486 A * 7/1955 Kleinsorge ..... A47B 3/0916 108/133
2,784,042 A * 3/1957 Clapper ..... A47B 3/0918 108/132
2,799,546 A * 7/1957 Lowry ..... A47B 3/0916 108/116
3,026,160 A * 3/1962 Bisp ..... A47B 3/0918 108/132
3,368,504 A * 2/1968 Cohen ..... A47B 3/087 108/131
3,769,920 A * 11/1973 Weiss ..... A47B 3/0918 108/133
4,143,602 A * 3/1979 Brunn ..... A47B 3/087 108/117
5,014,628 A * 5/1991 Roberts ..... A47B 3/0918 108/133
5,109,778 A * 5/1992 Berkowitz ..... A47B 3/0911 108/117
5,941,181 A 8/1999 Hornberger et al.
7,634,969 B2 * 12/2009 Neunzert ..... A47B 3/00 108/132
7,757,617 B2 * 7/2010 Larcom ..... A47B 3/0815 108/132
8,490,554 B2 * 7/2013 Jin ..... A47B 3/0915 108/132
8,534,205 B1 * 9/2013 Johnson ..... A47B 13/08 108/132
8,904,943 B2 * 12/2014 Jin ..... A47B 3/0818 108/127
2018/0279768 A1 * 10/2018 Leng ..... A47B 3/087

FOREIGN PATENT DOCUMENTS

CN 201727138 U 2/2011
CN 204218275 U 3/2015
CN 205597451 U 9/2016
CN 205597453 U 9/2016
GB 2417196 A 2/2006
RO 118519 B 6/2003

* cited by examiner

FOLDING TABLE

FIELD OF THE INVENTION

The present invention relates to a table, particularly to a lock structure of a table leg and a table top.

BACKGROUND OF THE INVENTION

Tables are traditional furniture. In a folding table, the table legs are foldable for transportation or storage. But the table legs are also easily folded when the table is used, the table may tip up or fall down. Therefore, a folding table that the table legs are locked when the table is unfolded and unable to be folded without any specific action is needed.

SUMMARY OF THE INVENTION

The present invention is provided with a folding table that the lock mechanism of the table leg locks the table leg when the table leg is unfolded. The technical proposal of the present invention is that:

A folding table, comprising table legs and support bars, the table legs are pivoted at the bottom portion of a table top, one end of the support bar is pivoted to the table leg, wherein the other end of the support bar is disposed with a sliding hook, the sliding hook is slidable along the side edge of the table top in the table leg, the side edge of the table top is disposed with a lock groove with an opening;

when the table leg is unfolded, the sliding hook is embedded in the lock groove; when the table leg is being folded, the external force is acted on the support bar to make the sliding hook separating from the lock groove and then the table leg is folded.

In above mentioned table, the table top comprises a first table top and a second table top pivoted together; the table legs are pivoted to the bottom of the first table top and the second table top; when the first table top and the second table top are unfolded, the back sides of the first table top and the second table top are opposite; wherein further comprising a lock mechanism to avoid relative rotating of the first table top and the second table top when being unfolded;

Compared to the exiting known technology, the technical proposal of the present invention has advantages as follows:

1. When the table leg is being unfolded, the sliding hook automatically enters the lock groove, the sliding hook is locked in the lock groove, the support bar is limited, the support bar prevents the table leg from rotating. The support bar is not needed to assembly independently, making it convenient to use; when the table leg is being folded, external force drives the sliding hook to separate from the lock groove, rotating the table leg reversely can achieve folding; the table leg would not be folded to make the table fall down due to misacting like touch otherwise a folding operation of a user.

2. Two table tops are locked in unfolding state; the two table tops would not in two different planes.

BRIEF DESCRIPTION OF THE DRAWINGS

The present invention will be further described with the drawings and the embodiments.

DETAILED DESCRIPTION OF THE EMBODIMENTS

Figure 1:
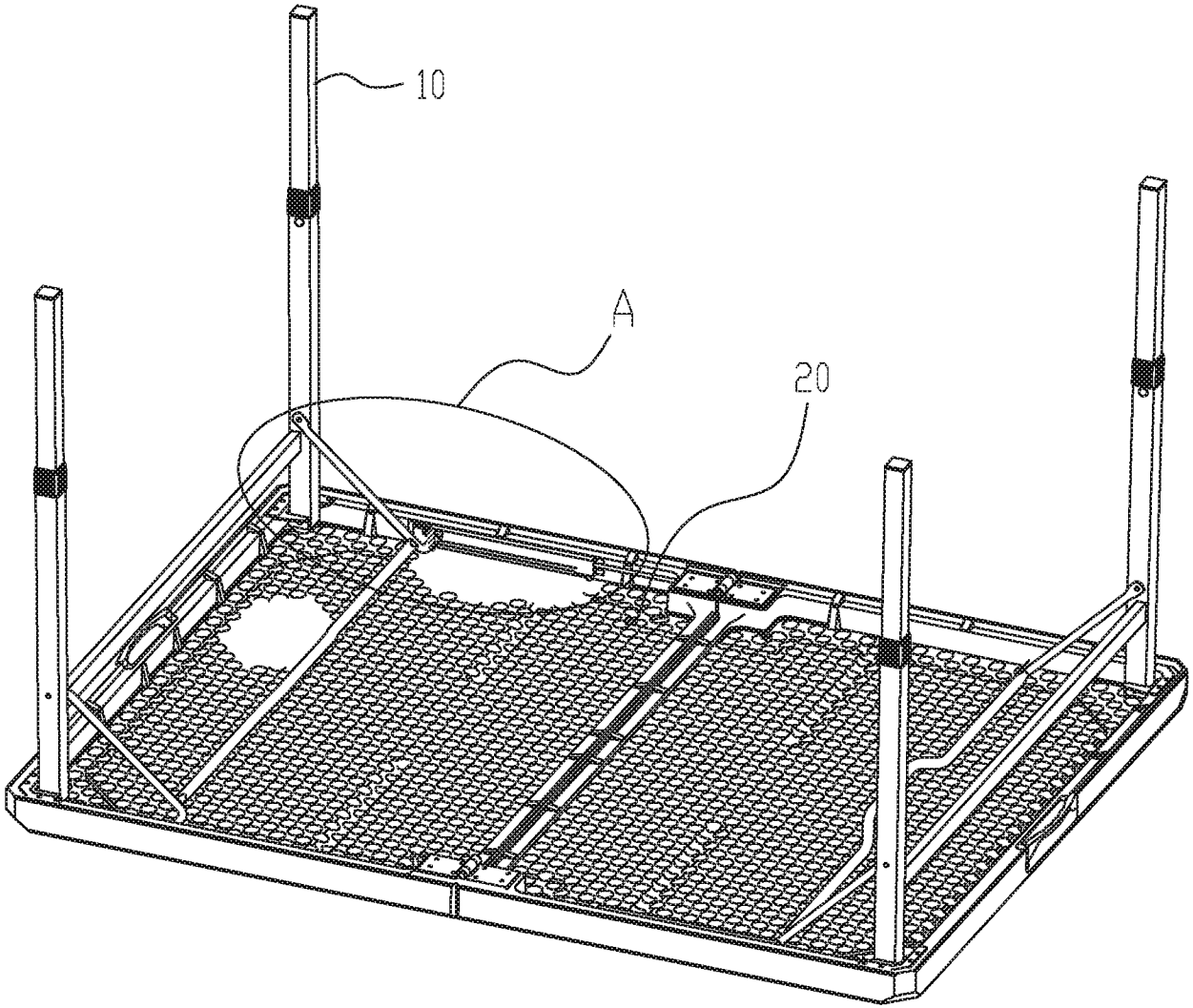
FIG. 1 illustrates a schematic diagram of the table.
Figure 2:
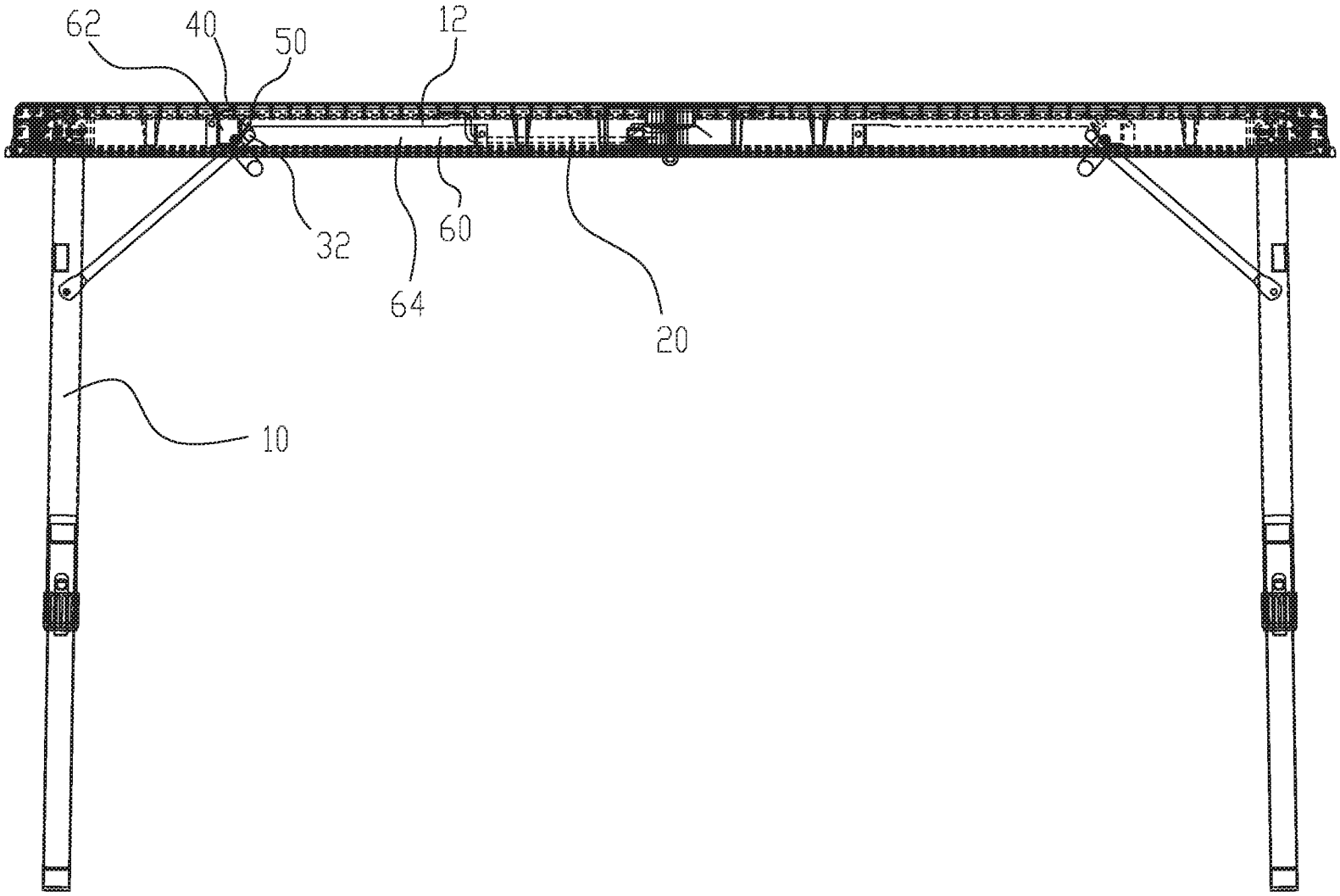
FIG. 2 illustrates a front view of the table of FIG. 1.
Figure 3:
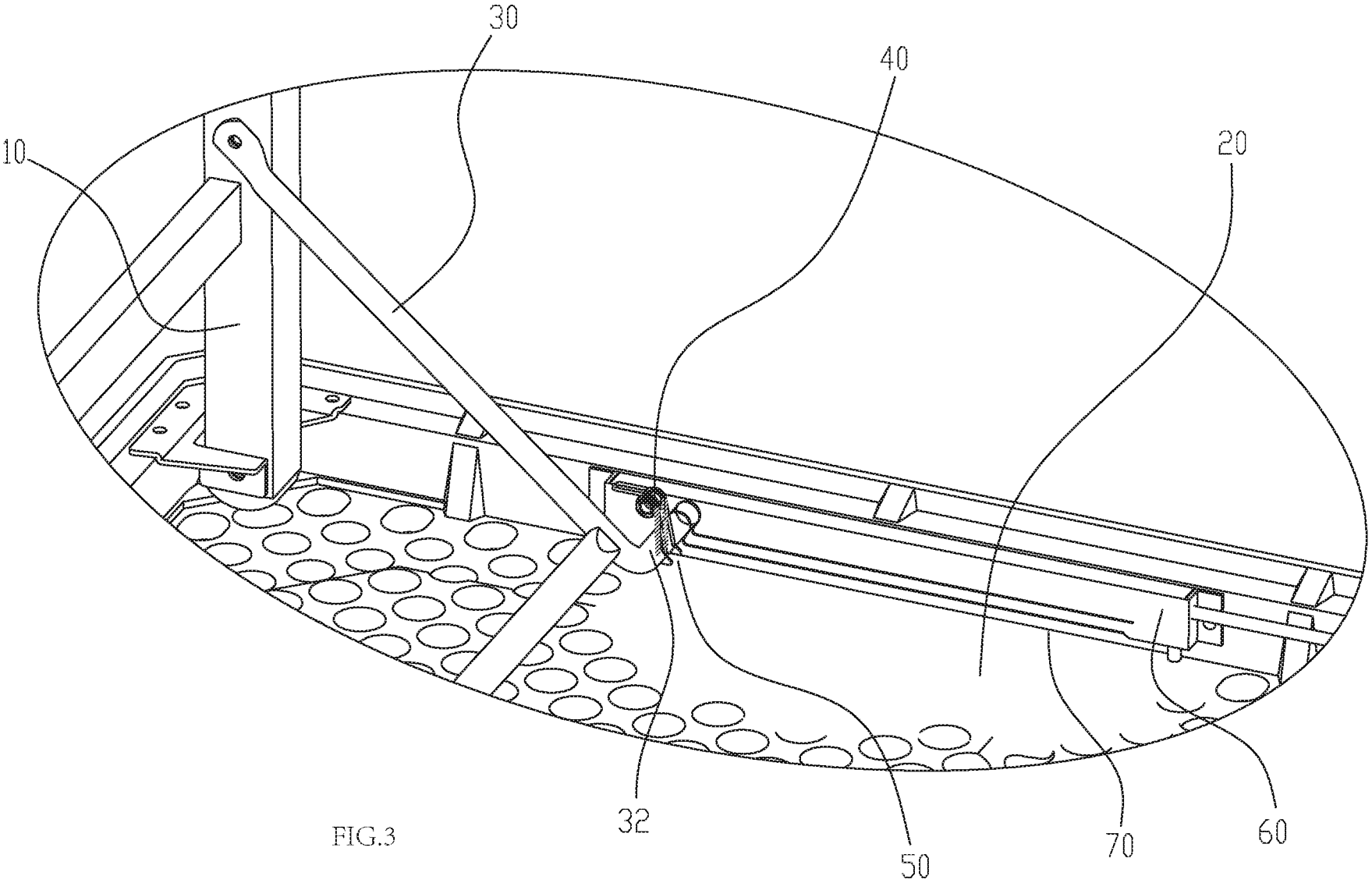
FIG. 3 illustrates an enlargement diagram of A in FIG. 1.
Figure 4:
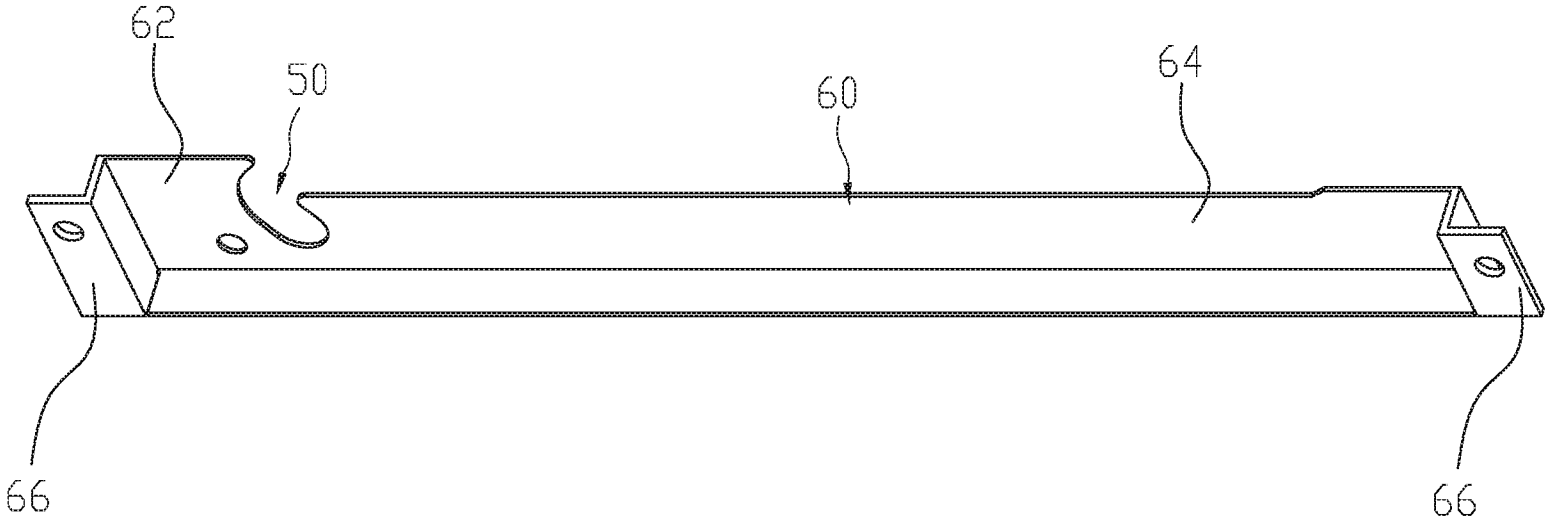
FIG. 4 illustrates a schematic diagram of the limit plate of the table of FIG. 1.
Figure 5:
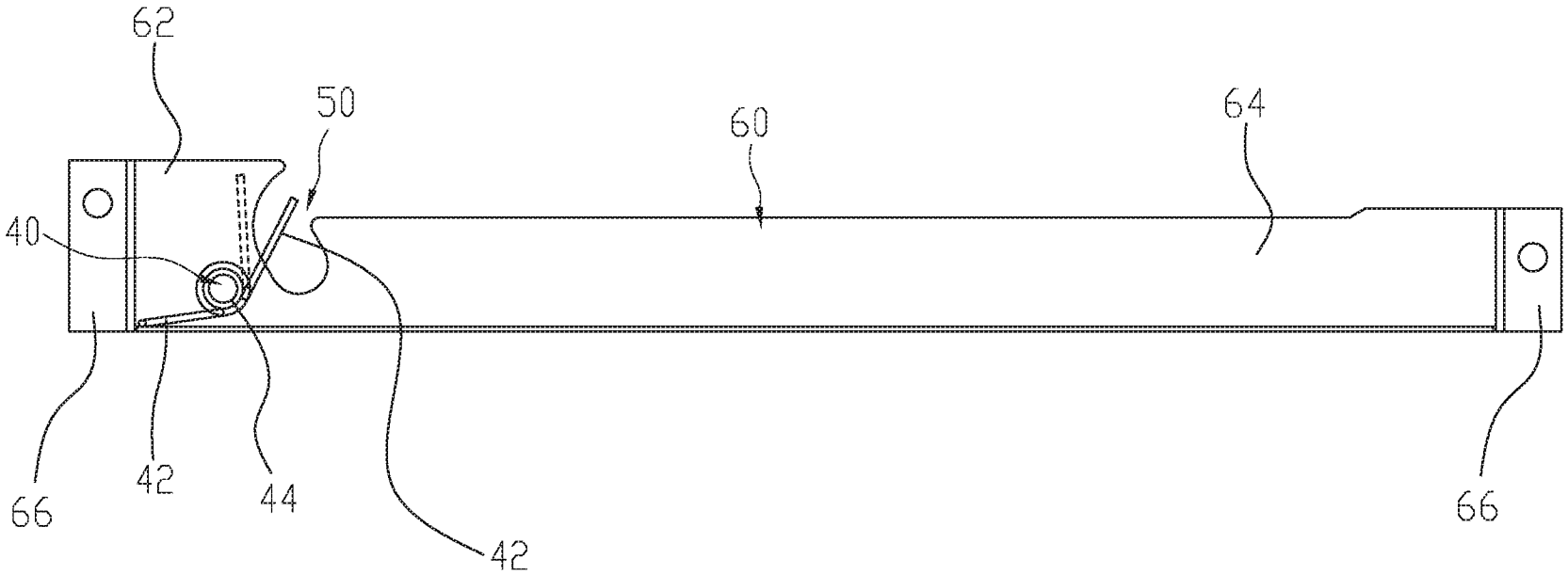
FIG. 5 illustrates a schematic diagram of the connecting of the limit plate and the elastic stop element of the table of FIG. 1.
Figure 6:
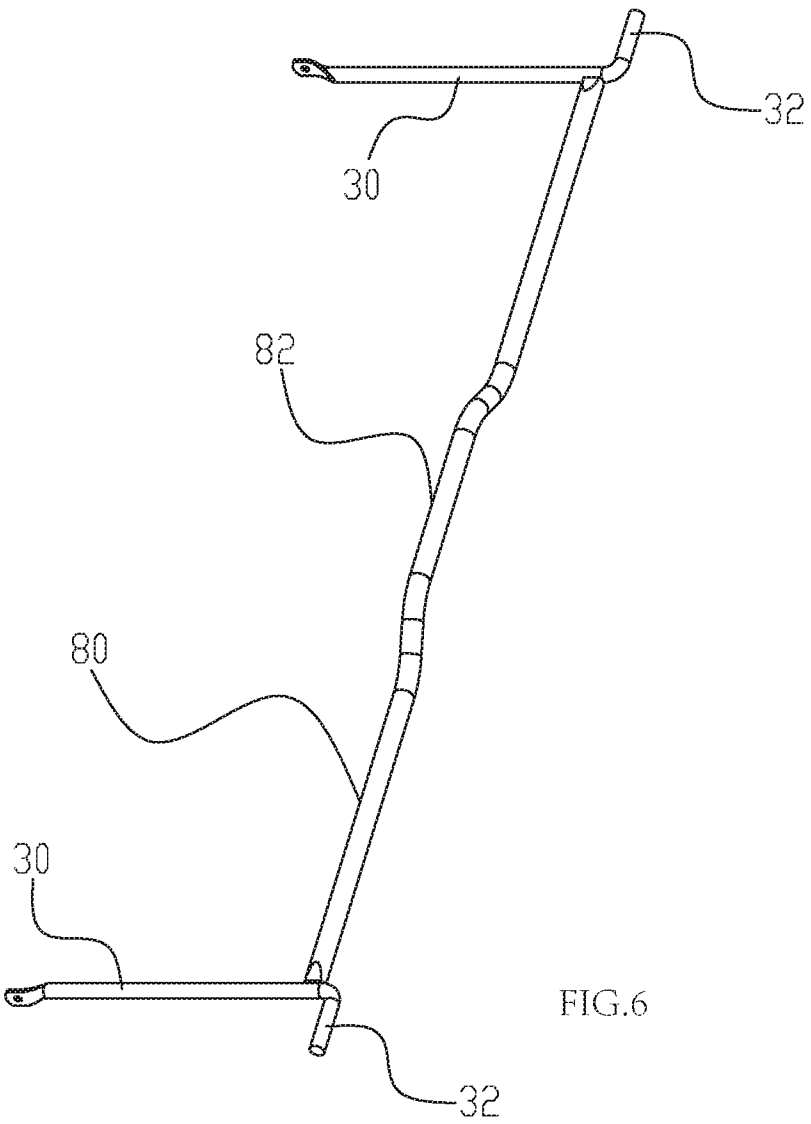
FIG. 6 illustrates a schematic diagram of the connecting of the linkage bar and the support bar.
Figure 7:
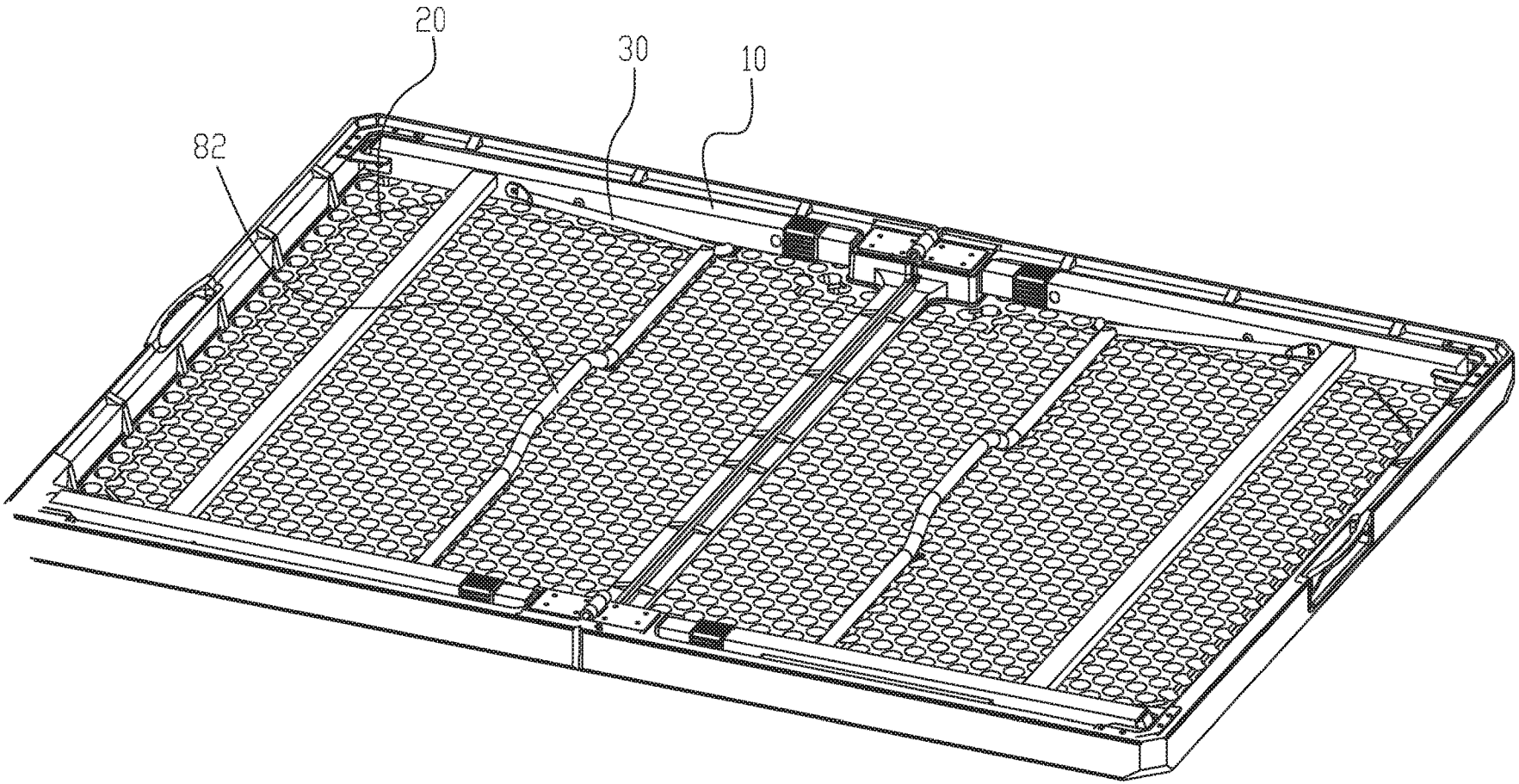
FIG. 7 illustrates a schematic diagram of the table of FIG. 1 when the table legs are folded.

Referring to FIGS. 1-7, the table comprises table legs 10 and a table top 20, the table legs 10 are pivoted to the bottom of the table top 20. The lock structure of the table leg of the present invention comprises a support bar 30 and an elastic stop element 40. One end of the support bar 30 is pivoted to the table leg 10, the other end is disposed with a sliding hook 32. The sliding hook 32 slides along the side edge of the table top when the table leg rotates. The side edge of the table top is disposed with a lock groove 50 with an opening. The elastic stop element 40 is used to stop the sliding hook 32 from getting in and out of the lock groove 50. When the table leg 10 is being rotated and unfolded, the sliding hook 32 slides along the side edge of the table top and presses the elastic stop element 40 to get into the lock groove 50; when the table top 20 is to be folded, the support bar 30 is pressed down, the sliding hook 32 presses the elastic stop element 40 down to get out of the lock groove 50, the table leg 10 can be rotated to be folded.

The inner side of the side edge of the table top is disposed with a limit plate 60, the lock groove 50 is disposed in the limit plate 60, the sliding hook 32 slides forth and back along the limit plate 60. The limit plate 60 comprises a front portion and the rear portion 64 connecting together. The lock groove 50 is disposed at the connecting position of the front portion and the rear portion and is arc shaped. The height of the front portion 62 is larger than that of the rear portion 64. The rear portion 64 of the limit board and the bottom surface of the table top 20 surround to form a sliding groove 12. The sliding hook 32 moves along the sliding groove 12. The sliding groove 12 is connected to the lock groove 50, forming a J shape.

Two ends of the limit plate 60 are respectively disposed with a lock piece 66 to connect to the table top 20. The limit plate 60 and the side edge of the table top surround to form an accommodating room, the elastic stop element 40 is disposed in the accommodating room. The elastic stop element 40 is a torsion spring with two torsion arms 42 and a spring ring 44 connecting the two torsion arms, one torsion arm 42 is positioned in the limit plate 60, the other torsion arm 42 is aligned with the opening of the lock groove. The sliding hook 32 abuts against the other torsion arm 42 when getting in and out of the lock groove 50.

Preferred, the support bars 30 of two adjacent table legs 10 are connected by a connecting bar 80. The central portion of the connecting bar 80 is disposed with an arch portion 82; when the table legs 10 are folded, a space for fingers to insert to is formed between the arch portion 82 and the table top 20.

It should be noted that, the object of the present invention can be achieved that: when the table leg 10 is open, only if the lock groove 50 can limit the sliding hook 32; when the table leg 10 is folded, only if the external force can drive the sliding hook 32 to separate from the lock groove 50. If the size of the opening of the lock groove is smaller than the size of the sliding hook 32, only under the action of the external force, the sliding hook 32 can get in and out of the lock groove 50, the support bar 30 can also be limited. Therefore, the elastic stop element 40 can be omitted.

Figure 8:
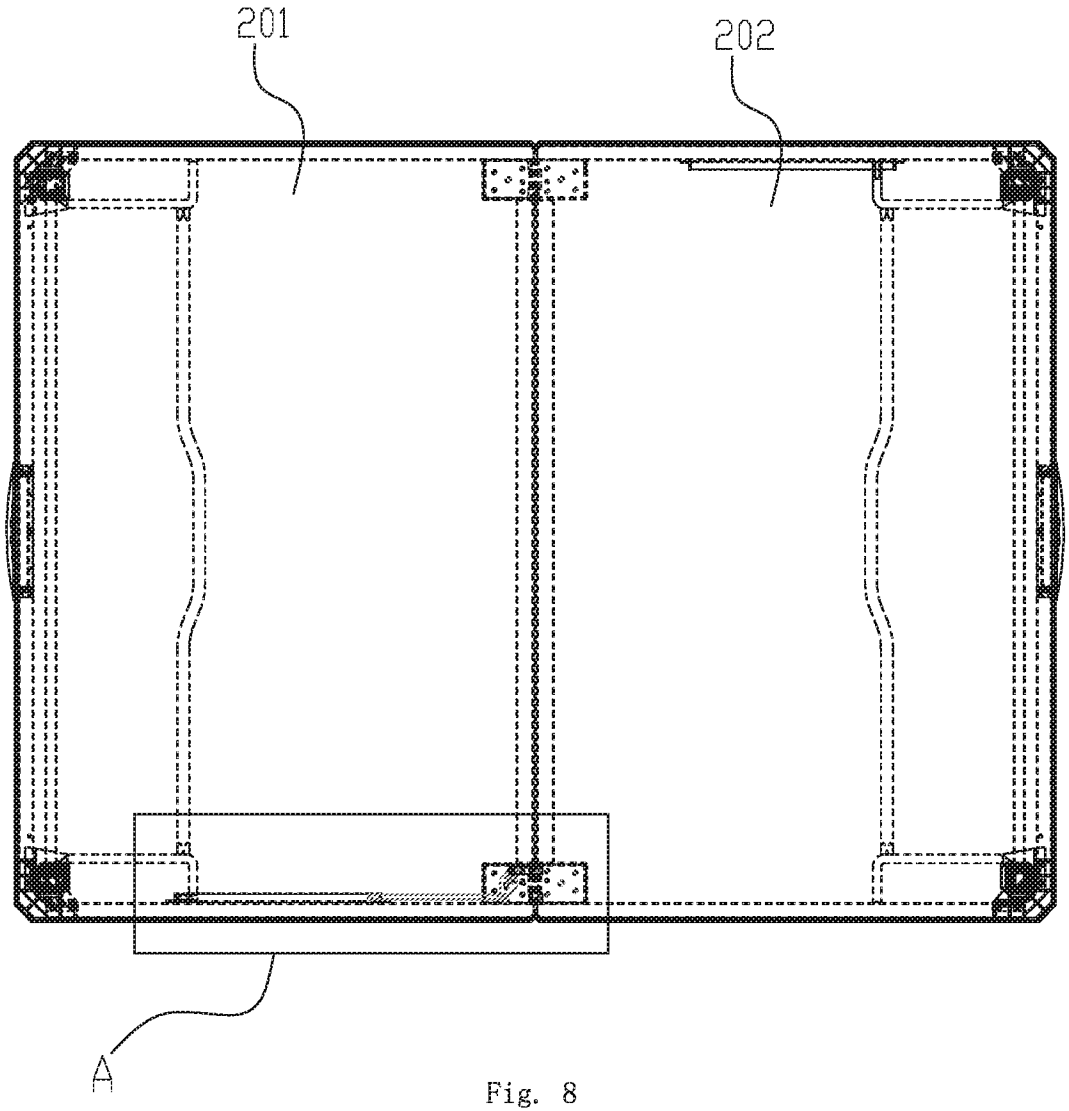
FIG. 8 illustrates a top view of the folding table.
Figure 9:
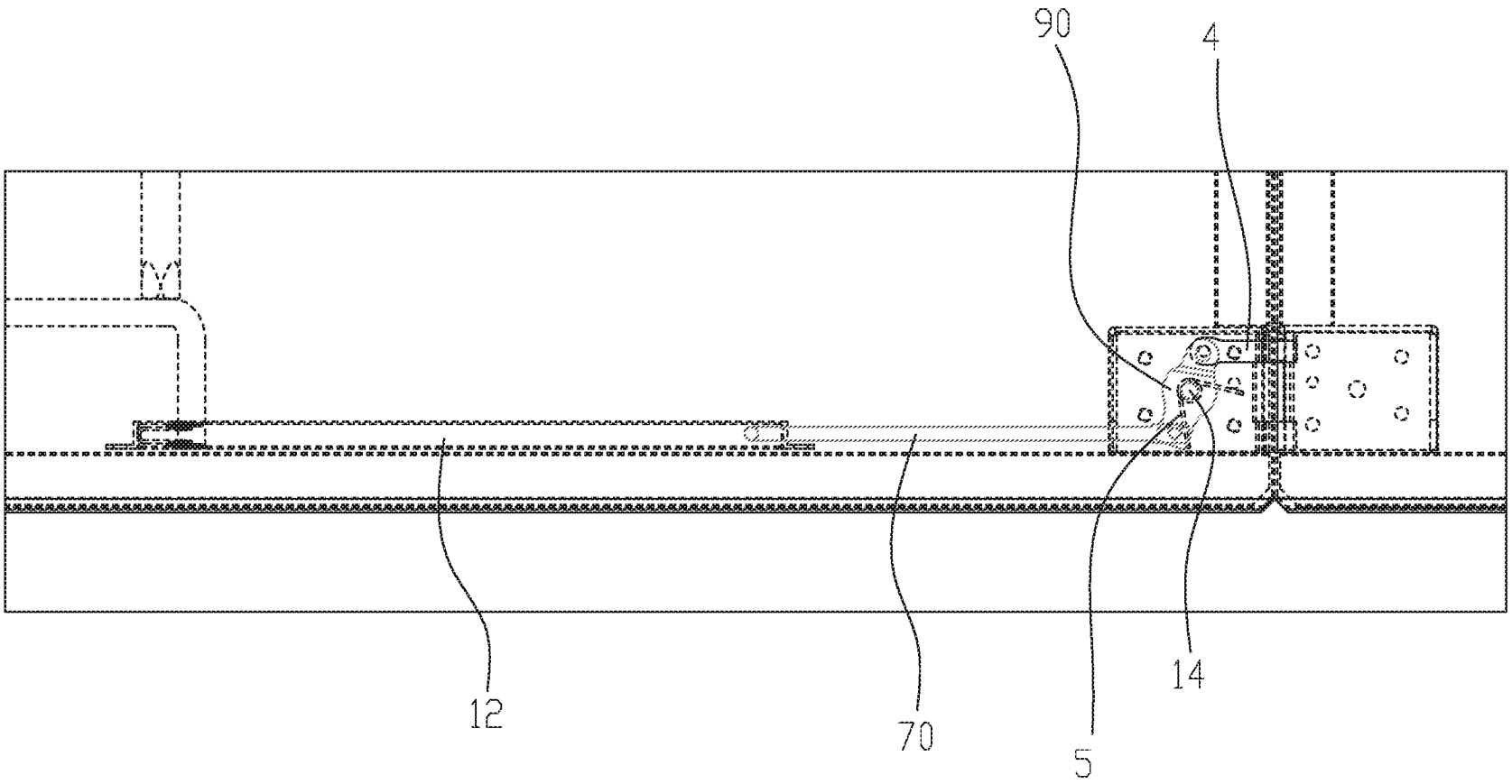
FIG. 9 illustrates an enlargement diagram of A of FIG. 8.
Figure 10:
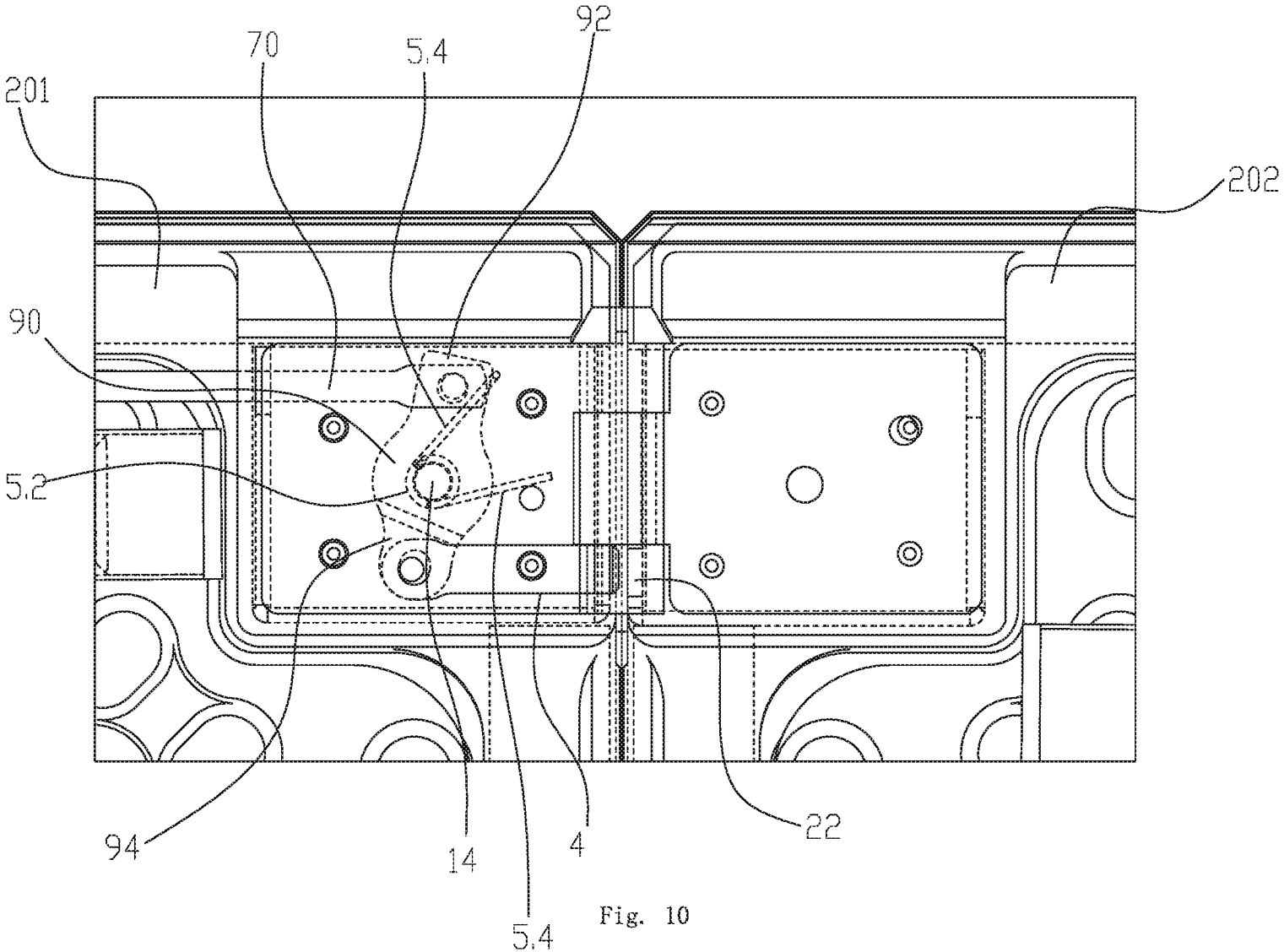
FIG. 10 illustrates a schematic diagram of the folding table of FIG. 8 when the insert pin exits out of the insert hole.
Figure 11:
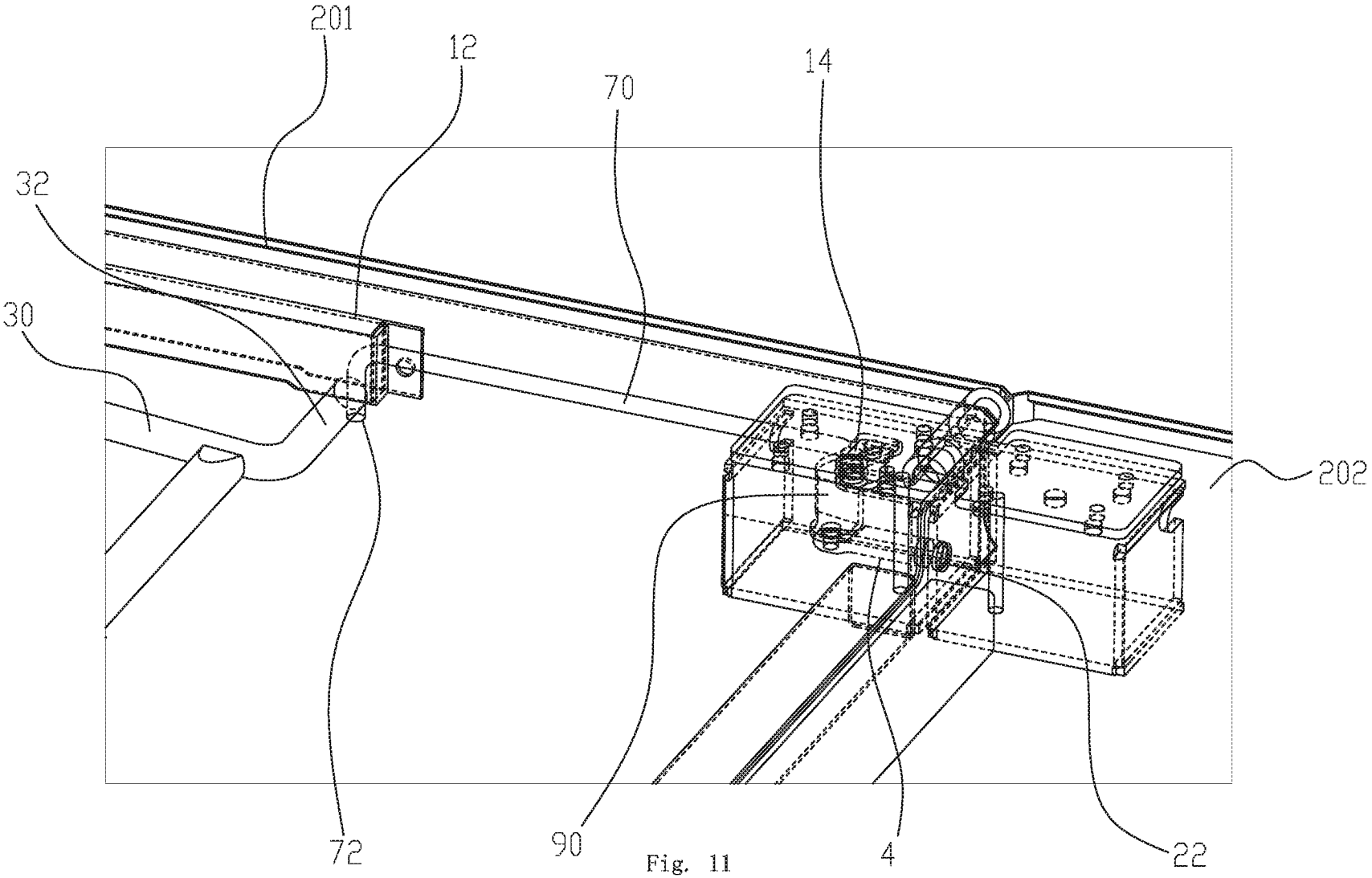
FIG. 11 illustrates an enlargement diagram of the relationship of the support bar and the push bar.
Figure 12:
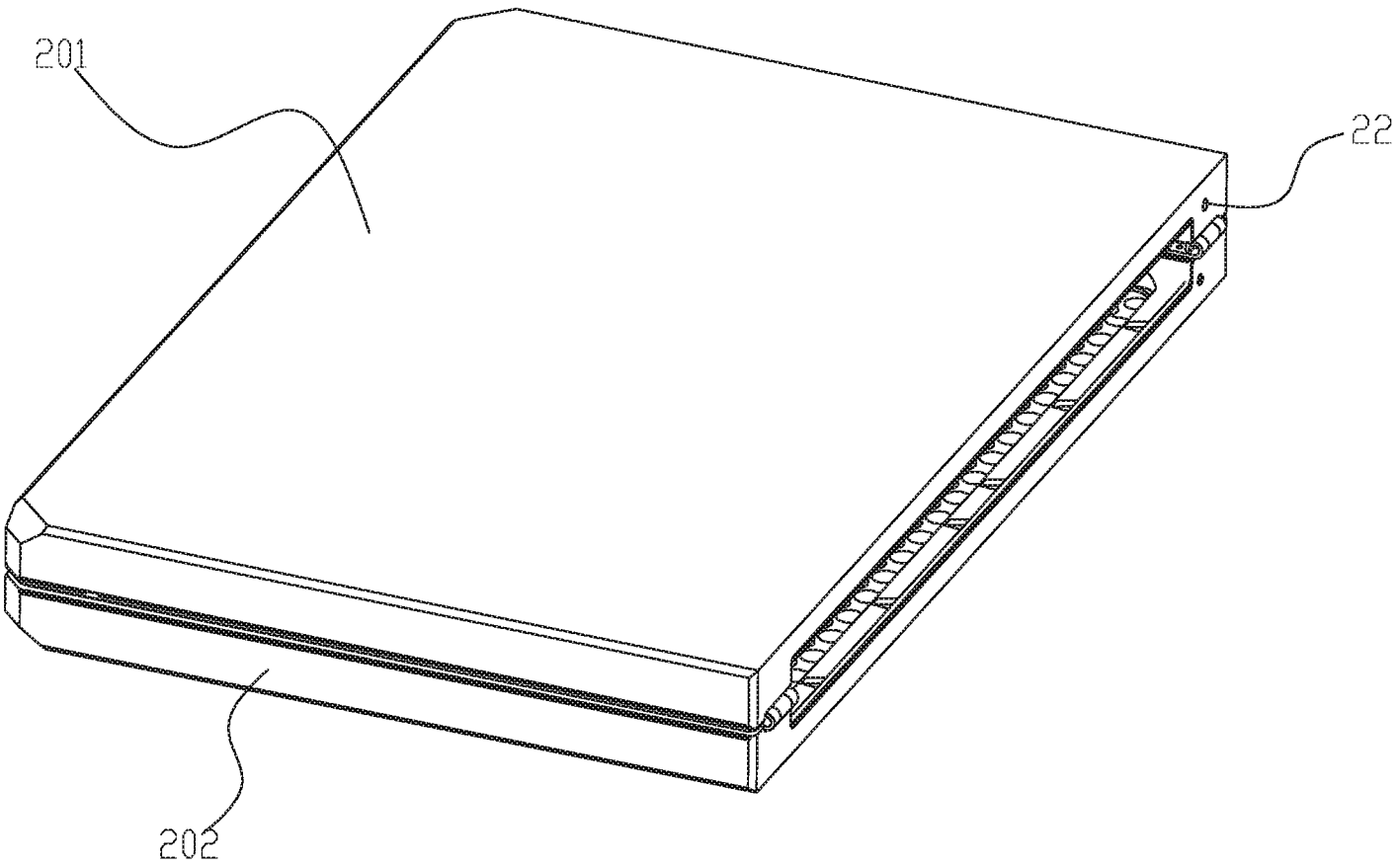
FIG. 12 illustrates a schematic diagram of the folding table when the first table top and the second table top are folded.
Figure 13:
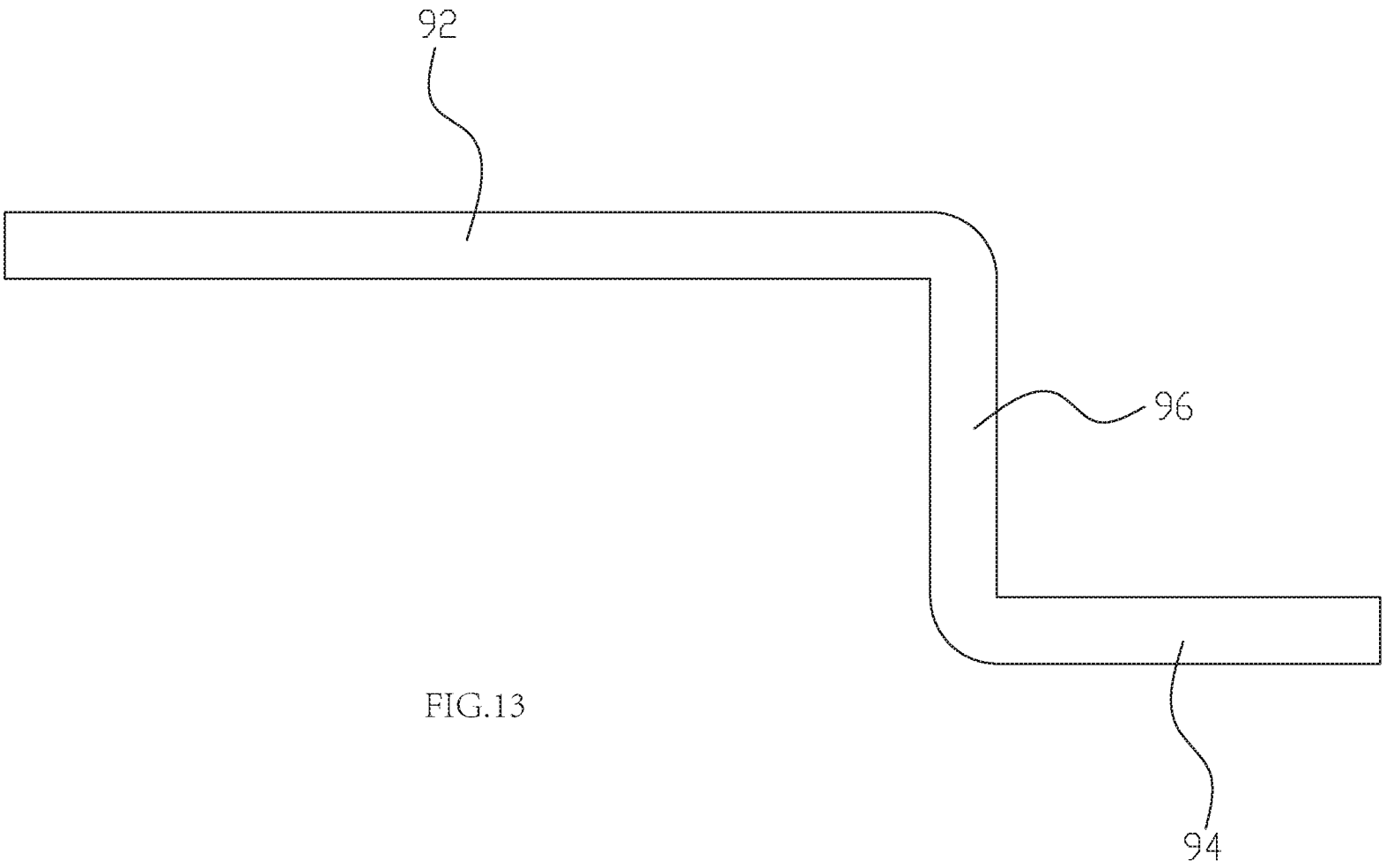
FIG. 13 illustrates a schematic diagram of the folding table of FIG. 1.

The table top of the present invention is a double-folding table, the table top can be self-locked. Referring to FIGS. 8-13, the table top comprises a first table top 201 and a second table top 202 pivoted together; the table legs are pivoted to the bottom of the first table top 201 and the second table top 202; when the first table top 201 and the second table top 202 are unfolded, the back sides of the first table top 201 and the second table top 202 are opposite; the folding table further comprises a lock mechanism to avoid relative rotating of the first table top 201 and the second table top 202 when being unfolded; the lock mechanism comprises an insert pin 4, which is movably disposed at the first table top 201; the second table top 202 is disposed with an insert hole 22, when the first table top 201 and the second table top 202 are unfolded, one end of the insert pin 4 extends out to insert to the insert hole 22.

The insert hole 22 is disposed at the back side of the second table top 202. The insert pin 4 is disposed at the inner side of the first table top 201 and extents out of the back side of the first table top 201; the lock mechanism further comprises an elastic element 5, the elastic force of the elastic element 5 pushes the insert pin 4 to extend out of the back side of the first table top 201 to insert to the insert hole 22.

The lock mechanism further comprises a rotating element 90 and a push bar 7, the rotating element 90 is disposed in the first table top 201 and rotates about the shaft, the insert pin 4 is pivoted to one end of the rotating element 90, the push bar 7 is pivoted to the other end of the rotating element 90; the elastic element 5 abuts against the other end of the rotating element 90. The push bar drives the rotating element 90 to rotate to make the insert pin inserted to or exit out of the insert hole when being pulled.

One end of the support bar 30 is pivoted to the table leg 10 of the first table top 201, the sliding hook 32 of the other end of the support bar 30 slides forth and back at the bottom portion of the first table top 201; when the table leg 10 is being folded, the other end of the support bar 30 pushes the push bar 7 to make the rotating element 90 overcome the elastic force of the elastic element 5 to rotate, the insert pin 4 exits out of the insert hole 22; when the table leg 10 is being unfolded, the support bar 30 slides to the table leg and separate from the push bar 7, the elastic force of the elastic element 5 pushes the rotating element 90 to rotate, the insert pin 4 inserts to the insert hole. Preferred, the side edge of the bottom portion of the first table top 201 is disposed with a sliding groove 12, the other end of the support bar is bended to form the sliding hook 32 to insert to the sliding groove 12; the end of the push bar 70 faced to the press bar is inserted to the sliding groove, the end of the push bar 70 faced to the support bar is bended to form a pressed portion 72, the sliding hook 32 abuts against the pressed portion 72.

The rotating element 90 comprises a top flat plate 92, a bottom flat plate 94 and a connecting plate 96 connecting the top flat plate 92 and the bottom flat plate 94; the insert pin 4 is pivoted to the bottom flat plate 94, the push bar 70 is pivoted to the top flat plate 92. The first table top 201 is disposed with a rotating shaft 14, the rotating element 90 rotates about the rotating shaft 14; the elastic element 5 is a torsion spring, which comprises a spring ring 5.2 and two torsion arms 5.4, the spring ring 5.2 is sleeved on the rotating shaft 14, one torsion arm 5.4 abuts against the first table top 201, the other torsion arm 5.4 abuts against the push bar or the rotating element 90. When used, the first table top 201 and the second table top 202 are unfolded, the table legs 10 are unfolded, the support bar 30 separates form the push bar 70, the elastic force of the elastic element 5 makes the rotating element 90 rotate and makes the insert pin 4 inserted to the insert hole 22.

To fold the table, the table legs 10 are folded, the support bar 30 pushes the push bar 70, the push bar 70 moves to make the rotating element 90 to rotate and drive the insert pin 4 to exit out of the insert hole 22, the first table top 201 and the second table top 202 are then folded.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims

The invention claimed is:

1. A folding table, comprising:

at least one table leg, at least one support bar, at least one sliding hook, and at least one elastic stop element, wherein:

each of the at least one table leg is pivoted at a bottom portion of a table top, a first end of each of the at least one support bar is pivotably coupled to a corresponding one of the at least one table leg, a second end of each of the at least one support bar is disposed with a corresponding one of the at least one sliding hook, each of the at least one sliding hook slides synchronously with a rotation of a corresponding one of the at least one table leg along a corresponding one of at least one side edge of the table top, each of the at least one side edge of the table top is disposed with at least one lock groove, each of the at least one lock groove comprises an opening, each of the at least one elastic stop element is configured to stop a corresponding one of the at least one sliding hook from sliding in and out of a corresponding one of the at least one lock groove, when the at least one table leg is unfolded, each of the at least one sliding hook presses a corresponding one of the at least one elastic stop element down and enters a corresponding one of the at least one lock groove, when the at least one table leg is folded, an external force acts on each of the at least one support bar to make a corresponding one of the at least one sliding hook press a corresponding one of the at least one elastic stop element down and exit a corresponding one of the at least one lock groove, each of the at least one elastic stop is a torsion spring with two torsion arms and a spring ring connecting the two torsion arms, a first torsion arm of the two torsion arms is positioned in a corresponding one of the at least one side edge of the table top, and a second torsion arm of the two torsion arms is aligned with the opening of the lock groove.

2. The folding table according to claim 1, wherein:

an inner side of each of the at least one side edge of the table top is disposed with at least one limit plate, each of the at least one lock groove is disposed at a corresponding one of the at least one limit plate, and each of the at least one sliding hook slides forth and back between a corresponding one of the at least one limit plate and a corresponding one of the at least one side edge of the table top.

3. The folding table according to claim 2, wherein:

each of the at least one limit plate and a corresponding one of the at least one side edge of the table top form at least one accommodating room, and each of the at least one elastic stop element is disposed in a corresponding one of the at least one accommodating room.

4. The folding table according to claim 1, comprising:

at least one connecting bar, wherein the at least one support bar comprises at least two support bars, a first support bar of the at least two support bars and a second support bar of the at least two support bars slide in a same direction, the first support bar is adjacent to the second support bar, and the first support bar is connected with the second support bar by a corresponding one of the at least connecting bar.

5. The folding table according to claim 4, wherein:

a central portion of each of the at least one connecting bar is disposed with an arch portion, and when the at least one table leg is folded, a space for receiving finger is formed between the arch portion and the table top.

6. The folding table according to claim 1, wherein:

the table top comprises:

a first table top, and a second table top, the first table top and the second table top are pivotably coupled, each of the at least one table leg is pivotable coupled to a bottom of the first table top or a bottom of the second table top, the first table top comprises at least one lock mechanism to avoid relative rotation of the first table top and the second table top when the first table top and the second table top are unfolded, each of the at least one lock mechanism comprises an insert pin, the insert pin is movably disposed at the first table top, the second table top is disposed with at least one insert hole, and when the first table top and the second table top are unfolded, a back side of the first table top and a back side the second table top are co-planer and a first end of each of the at least one insert pin extends out to insert into a corresponding one of the at least one insert hole.

7. The table top according to claim 6, wherein:

each of the at least one insert hole is disposed at the back side of the second table top.

8. The table top according to claim 7, wherein:

each of the at least one insert pin is disposed at an inner side of the first table top, each of the at least one lock mechanism further comprises an elastic element, and an elastic force of each of the at least one elastic element pushes a corresponding one of the at least one insert pin to extend out of the back side of the first table top to insert into a corresponding one of the at least one insert hole.

9. The folding table according to claim 8, comprising:

at least one rotating element, wherein each of the at least one lock mechanism further comprises a corresponding one of the at least one rotating element, each of the at least one rotating element is disposed in the first table top and rotates about a center portion of a corresponding one of the at least one rotating element, each of the at least one insert pin is pivoted to a first end of a corresponding one of the at least one rotating element, and each of the at least one elastic element abuts against a second end of a corresponding one of the at least one rotating element.

10. The folding table according to claim 9, comprising:

at least one push bar, wherein each of the at least one lock mechanism further comprises a corresponding one of the at least one push bar, a first end each of the at least one push bar is pivotably coupled to the second end of a corresponding one of the at least one rotating element; and each of the at least one push bar is pulled to drive a corresponding one of the at least one rotating element to rotate to make a corresponding one of the at least one insert pin insert into or exit out of a corresponding one of the at least one insert hole.

11. The folding table according to claim 10, wherein:

the first end of each of the at least one support bar slides forth and back at a bottom portion of the first table top, when the at least one table leg is folded:

the second end of each of the at least one support bar pushes a corresponding one of the at least one push bar to make a corresponding one of the at least one rotating element overcome the elastic force of a corresponding one of the at least one elastic element to rotate, and each of the at least one insert pin exits out of a corresponding one of the at least one insert hole, and when the at least one table leg is unfolded:

each of the at least one support bar and a corresponding one of the at least one push bar is separated, the elastic force of each of the at least one elastic element pushes a corresponding one of the at least one rotating element to rotate, and each of the at least one insert pin inserts into a corresponding one of the at least one insert hole.

12. The folding table according to claim 9, wherein:

each of the at least one rotating element comprises a top flat plate, a bottom flat plate and a connecting plate connecting with the top flat plate and the bottom flat plate, the bottom flat plate is pivotably coupled to a corresponding one of the at least one insert pin, and the top flat plate is pivotably coupled to a corresponding one of the at least one push bar.

13. The folding table according to claim 9, wherein:

the first table top comprises at least one rotating shaft, each of the at least one rotating element rotates about a corresponding one of the at least one rotating shaft, each of the at least one elastic element is a torsion spring that comprises a spring ring, a first torsion arm and a second torsion arm, the spring ring is sleeved on a corresponding one of the at least one rotating shaft, the first torsion arm abuts against the first table top, and the second torsion arm abuts against a corresponding one of the at least one push bar or a corresponding one of the at least one rotating element.

14. A folding table, comprising:

at least one table leg, at least two support bars, at least one sliding hook, and at least one connecting bar, wherein:

each of the at least one table leg is pivoted at a bottom portion of a table top, a first end of each of the at least two support bars is pivotably coupled to a corresponding one of the at least one table leg, a second end of each of the at least two support bars is disposed with a corresponding one of the at least one sliding hook, each of the at least one sliding hook slides synchronously with a rotation of a corresponding one of the at least one table leg along a corresponding one of at least one side edge of the table top, each of the at least one side edge of the table top is disposed with at least one lock groove, each of the at least one lock groove comprises an opening, a central portion of each of the at least one connecting bar is disposed with an arch portion, when the at least one table leg is unfolded, each of the at least one sliding hook is disposed in a corresponding one of the at least one lock groove, when the at least one table leg is folded:

an external force acts on each of the at least two support bars to make a corresponding one of the at least one sliding hook separate from a corresponding one of the at least one lock groove, and a space for receiving fingers is formed between the arch portion and the table top, a first support bar of the at least two support bars and a second support bar of the at least two support bars slide in a same direction, the first support bar is adjacent to the second support bar, and the first support bar is connected with the second support bar by a corresponding one of the at least connecting bar.

15. A folding table, comprising:

at least one table leg, at least one support bar, and at least one sliding hook, wherein:

each of the at least one table leg is pivoted at a bottom portion of a table top, a first end of each of the at least one support bar is pivotably coupled to a corresponding one of the at least one table leg, wherein a second end of each of the at least one support bar is disposed with a corresponding one of the at least one sliding hook, each of the at least one sliding hook slides synchronously with a rotation of a corresponding one of the at least one table leg along a corresponding one of at least one side edge of the table top, each of the at least one side edge of the table top is disposed with at least one lock groove, each of the at least one lock groove comprises an opening, when the at least one table leg is unfolded, each of the at least one sliding hook is disposed in a corresponding one of the at least one lock groove, when the at least one table leg is folded, an external force acts on each of the at least one support bar to make a corresponding one of the at least one sliding hook separate from a corresponding one of the at least one lock groove, the table top comprises:

a first table top, and a second table top, the first table top and the second table top are pivotable coupled, each of the at least one table leg is pivotable coupled to a bottom of the first table top or a bottom of the second table top, the first table top comprises at least one lock mechanism to avoid relative rotation of the first table top and the second table top when the first table top and the second table top are unfolded, each of the at least one lock mechanism comprises an insert pin, the insert pin is movably disposed at the first table top, the second table top is disposed with at least one insert hole, and when the first table top and the second table top are unfolded, a back side of the first table top and a back side the second table top are co-planar and a first end of each of the at least one insert pin extends out to insert into a corresponding one of the at least one insert hole.

* * * * *